United States Patent [19]

Gutmann

[11] Patent Number: 4,698,188

[45] Date of Patent: Oct. 6, 1987

[54] EVAPORATION AIR HUMIDIFIER

[75] Inventor: Franz Gutmann, Rebstein, Switzerland

[73] Assignee: Plaston AG, Widnau, Switzerland

[21] Appl. No.: 877,003

[22] Filed: Jun. 20, 1986

[30] Foreign Application Priority Data

Apr. 21, 1986 [CH] Switzerland ..... 01613/86

[51] Int. Cl.[4] ..... B01F 3/04

[52] U.S. Cl. ..... 261/107; 261/120

[58] Field of Search ..... 261/120, 107

[56] References Cited

U.S. PATENT DOCUMENTS

| | | | |
|---|---|---|---|
| 1,888,059 | 11/1932 | Wannack | 261/120 |
| 2,856,166 | 10/1958 | Goettl | 261/29 |
| 2,998,714 | 9/1961 | Bonzer | 261/DIG. 4 |
| 3,864,437 | 2/1975 | Blaszkowski | 261/120 |
| 4,448,593 | 5/1984 | Spiers | 261/120 |

FOREIGN PATENT DOCUMENTS

| | | | |
|---|---|---|---|
| 2356040 | 10/1975 | Fed. Rep. of Germany . | |
| 3312367 | 11/1984 | Fed. Rep. of Germany . | |
| 615010 | 12/1979 | Switzerland | 261/120 |

*Primary Examiner*—Tim Miles

*Attorney, Agent, or Firm*—Tarolli, Sundheim & Covell

[57] ABSTRACT

The evaporation air humidifier comprises a housing consisting of an upper part (1) and a lower part (2) forming a water chamber (3). A drive unit (4) with a fan blade (5) is arranged on the upper part (1). An intermediate part (6) is located in the housing and floats on the water with its bottom surface lying on the water surface. The intermediate part (6) is guided by a slide pipe (19) and carries an evaporation mat (7), the lower end (17) of which is always submerged into the water tank (3) to the same length. The water is sucked through openings (15) into the evaporation mat (7), and humidifies the stream of air which passes therethrough in the direction of arrows (30, 31) and is discharged through the outlet openings (9).

4 Claims, 1 Drawing Figure

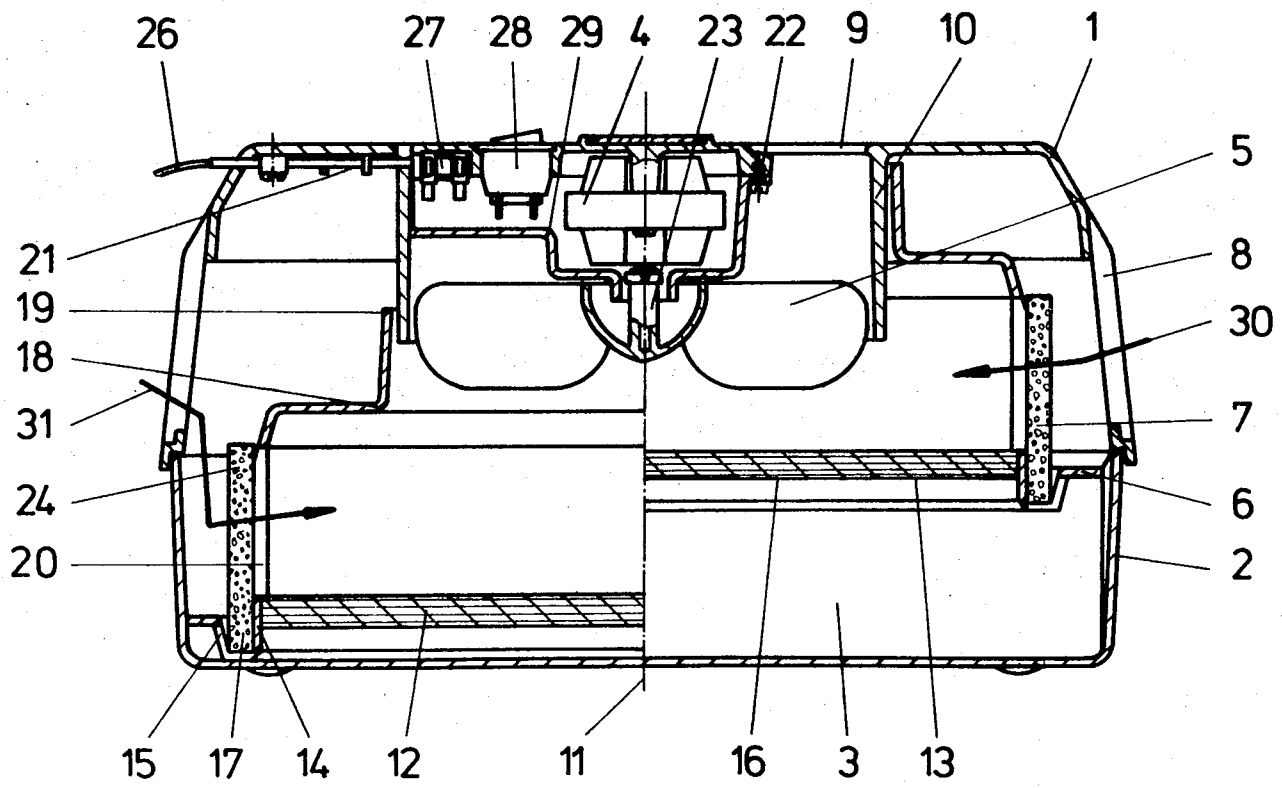
1
10
9
22
23
4
29
28
27
26
5
8
30
7
6
2
13
3
16
11
12
14
17
15
21
19
18
31
24
20

EVAPORATION AIR HUMIDIFIER

The invention relates to an evaporation air humidifier with a forced ventilation. The humidifier comprises a housing consisting of an upper part and a lower part that forms a water chamber. A drive unit with a ventilation fan blade and an intermediate part with an evaporation mat are located in the housing which also has air inlet and outlet openings.

An evaporation air humidifier of this kind is known from German Pat. No. 2,356,040. This known air humidifier has a several-part housing with a water chamber arranged in a lower part. A mounting plate arranged above the water chamber is connected with the upper part of the housing. A drive unit with a through shaft having a fan blade mounted on one end thereof and a water pump mounted on the other end thereof, is fastened to the mounting plate. The mounting plate also supports an evaporation mat, which extends along the circumference of the apparatus. A dividing channel for the water conducted through a connection line from the immersion pump in the water tank is provided at the upper end of the evaporation mat. From the channel, the water flows through the evaporation mat to the mounting plate, which is designed as a collection tank for the water, and from here flows back through a return pipe into the water tank.

The disadvantage of such a structure is that the immersion pump, in accordance with the water level in the water tank, requires different drive power for carrying the water into the distribution ring. Since the fan blade is mounted on the same drive shaft as the water pump, variation of the load on the water pump changes the RPM of the fan blade in an undersirable manner. Changes in the RPM of the fan blade lead to a change in the humidifying capacity of the apparatus, and with higher RPM's, distribution noises may occur. The water flowing through the evaporation mat also carries dirt particles, filtered out of the air from the mat, into the water tank. This leads to a great contamination of the water in the water tank and, as this increases, to clogging up of the water pump and/or the water distribution channel at the upper end of the evaporation mat. Since the drive unit, the added electric parts and feed lines are arranged in the water-carrying zone of the apparatus, additional protective measures are necessary, which leads to a higher cost.

The object of the present invention is to provide an evaporation air humidifier with forced ventilation, in which, independently of the water level in the water tank, the same evaporation capacity is always achieved, no water pump is necessary, and the drive unit as well as the electric parts can be arranged in the part of the housing free of water. Moreover, the water in the water tank is to be protected from contamination.

This problem is solved by fastening the drive unit with the fan blade to the upper housing part and by providing an intermediate part floating on the body of water and with no rigid connection with the housing parts, and which can be moved along the housing axis.

One advantage of the evaporation air humidifier according to the invention is that the evaporation mat is always equally moistened, independently of the water level in the water tank. Also, the mat surface area exposed to the stream of air flowing therethrough is always of the same size. This is attained by the fact that the intermediate part floats with the evaporation mat on the surface of the water, and the lower part of the evaporation mat is always submerged into the water to the same length. If the water level in the water tank falls because of the evaporation of water, the intermediate part with the evaporation mat, sinks downward, and the wall, connected to the upper part of the evaporation mat, moves downward to the same degree, since it is connected, through the support ribs (fins, flanges) of the evaporation mat with the intermediate part. In this way it is assured, to the lowest possible water level that the mat always absorbs the same amount of water, and the stream of air is always in a contact with the same size of mat surface area. As a further advantage, a water pump is no longer necessary, and the drive unit need drive only the fan blade and no water pump anymore. In this way, the drive unit may be of smaller size. Moreover, the RPM of the fan blade may be set beforehand or made variable, and is independent of other influences. This makes possible the choice of an ideally quiet drive, and the noise of water flowing back is also eliminated. By the fact that no drive parts or parts connected with the electric unit project into the water, greater electric safety is achieved, and all electrical parts may be built compactly on the upper part of the housing. The structure according to the invention permits an ideal control of the air humidity and, at the same time, a simpler construction of an evaporation air humidifier with forced ventilation.

Other details, features and advantages of the invention will appear from the description which follows, and the respective drawing which represents schematically a section through an evaporation air humidifier according to the invention, the left part of the drawing showing the intermediate part at the minimum water level, and the right part showing the intermediate part at the maximum water level.

The evaporation air humidifier represented in the figure consists of an upper housing part 1 and a lower housing part 2. The lower housing part 2 forms a water tank 3 which is provided with a water-level indicator, not shown. The air humidifier has a cylindrical cross section. The side circumferential surface of the upper housing part 1 is provided with air inlet openings 8. The top end surface of the housing part 1 is provided with air outlet openings 9, through which a humidified stream of air is discharged. A drive unit 4 is arranged in the center portion of the upper housing part 1 on the axis 11 thereof and is connected, by fastening means 22, to the housing part 1. A fan blade 5 is mounted on the axle 23 of the drive unit 4 for communicating the air from the inlet openings 8 in the direction of the arrows 30, 31, to the outlet openings 9. The drive unit 4 and the fan blade 5 form an axial ventilation unit which may be replaced in the known way by a radial ventilator. An air conducting pipe 10 is arranged coaxially with the drive unit 4 and the fan blade 5. The pipe 10 extends downward to at least above the middle of the fan blade 5. A dust-proof protective housing 29 is arranged within this air conduction pipe 10. The housing encloses electric elements such as terminals 27, switch 28 and the drive unit 4. The upper housing part 1 includes a cable connection which leads to terminals 27.

An intermediate part 6 is located in the space formed by the upper housing part 1 and the lower housing part 2. The part 6 is freely movable within the space in opposite directions along the housing axis 11. Its movement is limited, upward, by the inner surface 21 of the housing part 1, and downward by the bottom of the water tank 3. This intermediate part 6 comprises support ridges 20 for an evaporation mat 7, a float element 12, a channel 14 and a wall 18 connected to the upper part 24 of the evaporation mat 7 and to a sliding pipe 19. The sliding pipe 19 is arranged with a clearance around the outer surface of the air conducting pipe 10 and guides the intermediate part 6 in its movements along the housing axis 11.

If the water tank 3 is filled with the water to a maximum level, the water surface 16 coincides with the bottom surface 13 of the float element 12 of the intermediate part 6. This float element 12 is formed, in the example shown, of a light plastic disc connected to the channel 14 which has holes 15 that make possible a contact between water and the lower part 17 of the evaporation mat 7. The mat 7 consists of absorptive plastic or other suitable material, and is arranged as a ring around the support ridges 20. The material of the mat 7 is so chosen that water is sucked into the upper part 24, and the air flowing through is humidified over the whole surface. As a result of the water picked up by the air flowing through, the water level 16 falls, and the whole intermediate part 6 moves downward with the falling of the water level 16. Because of this, the channel 14 with the lower part 17 of the evaporation mat 7 is always submerged into the water to the same depth so that the suction conditions of the evaporation mat 7 remain constant. Since the wall 18 and the slide pipe 19 are connected, through the support ridges 20, with the float body 12 and the channel 14, those parts move downward to the same degree.

The slide pipe 19, sliding along the air conduction pipe 14, prevents air that flows from the air inlet openings 8 from being sucked into the air conduction pipe 10. The air must, in each case, flow first from the air inlet openings 8, in the direction of the arrows 30, 31, through the evaporation mat 7, and only then can it flow by means of the fan blade(s) 5 to the air outlet openings 9. When the water surface 16 falls to the lowest level, the channel 14 abuts the bottom of the housing part 2, while the slide pipe 19 still covers a part of the air conduction pipe 10.

The float element 12, during the whole operation of the evaporation air humidifier, covers the water surface 16, and prevents dirt and microorganisms from getting into the water tank 3. In this way, the contamination of the water in the tank 3 is reliably prevented. Dirt particles which are deposited, from the air suctioned through, in the evaporation mat 7, are held back there and may be rinsed out of the mat 7 from time to time. Since none of the electric elements 27, 28 and 4, are connected with the lower, water-carrying, housing part 2, obviously, great electric safety is provided. Since the intermediate part 6 has no rigid connection with the lower housing part 2, and also no rigid connection with the upper housing part 1, a simpler construction is possible and the parts can be easily asssembled.

I claim:

1. An air humidifier comprising:

a housing having air inlet opening means for receiving dry air thereinto and air outlet opening means for delivering humidified air therefrom;

an electrically driven air ventilation unit for drawing the dry air into said inlet opening means and forcing the humidified air from said outlet opening means, said air ventilation unit comprising a drive unit and a fan blade and being located in said housing, an evaporation mat located in the air stream through said housing for humidifying the dry air, said housing comprising an upper part and a lower part defining a water chamber and an intermediate part which floats on water in said water chamber, said intermediate part having no rigid connection with said upper and lower housing part and being movable along the axis of said housing as the level of water in the water chamber varies, said intermediate part having a bottom surface covering the entire water surface and preventing said dry inlet air from contacting the water in said water chamber, a float element in the zone of its bottom surface, and a portion supporting said evaporation mat in a position where said evaporation mat projects at least partially below the surface of the water so that said mat is wetted by the water, said air humidifier further comprising an air conducting pipe surrounding said ventilation unit, and said intermediate part including a wall attached to the upper portion of said evaporation mat and constantly slidingly engaging said air conducting pipe during movement of said intermediate part along the housing axis thereby separating the dry air received through said air inlet opening means from the humidified air delivered through said air outlet opening means and causing the dry air to flow only through said evaporation mat.

2. An air humidifier according to claim 1 wherein said evaporation mat is ring-shaped and is supported on support ridges on the intermediate part and may be replaced on said intermediate part without removing any fasteners therefrom.

3. An air humidifier according to claim 2 wherein said portion of said intermediate part that supports said evaporation mat defines a channel projecting below the water surface and having openings for communicating water to said evaporation mat.

4. An air humidifier according to claim 1 wherein all electrical parts thereof are located in said upper housing part and further comprising means for preventing communication between said water chamber and said electrical parts.

* * * * *